US005727340A

United States Patent [19]

Suk

[11] Patent Number: 5,727,340

[45] Date of Patent: Mar. 17, 1998

[54] PLASTIC GOLF SHOE SPIKE

[76] Inventor: Young J. Suk, 270 Glen Cove Ave., Sea Cliff, N.Y. 11579

[21] Appl. No.: 798,355

[22] Filed: Feb. 10, 1997

[51] Int. Cl.[6] ..... A43C 15/16; A43C 15/02

[52] U.S. Cl. ..... 36/134; 36/127; 36/67 D; 36/59 R

[58] Field of Search ..... 36/127, 134, 67 D, 36/59 A, 59 C, 59 R, 67 R

[56] References Cited

U.S. PATENT DOCUMENTS

| | | | |
|---|---|---|---|
| 3,082,549 | 3/1963 | Dolceamore | 36/134 |
| 5,533,282 | 7/1996 | Kataoka et al. | 36/134 |

FOREIGN PATENT DOCUMENTS

| | | | |
|---|---|---|---|
| 2737765 | 3/1979 | Germany | 36/59 R |
| 632239 | 1/1962 | Italy | 36/67 D |

*Primary Examiner*—Paul T. Sewell
*Assistant Examiner*—Anthony Stashick
*Attorney, Agent, or Firm*—Myron Amer PC

[57] ABSTRACT

A golf shoe spike which does not produce so-called spike marks in a putting green due to the use of plastic construction material in which to obviate rupture of the plastic during tightening and untightening preparatory to replacement of a worn spike, the peripheral edge of the spike body is non-circular for improved turning engagement with a wrench having a matching non-circular spike body-receiving compartment and, at each change in direction characteristic of the non-circular spike body edge, a spike is located to provide optimum plastic material since the spike location coincides with a contact site at which the wrench and spike body interengage each other during the tightening and untightening of the spike.

1 Claim, 1 Drawing Sheet

PLASTIC GOLF SHOE SPIKE

The present invention relates generally to an improved golf shoe spike, and more particularly to the use of plastic, rather than metal, construction material for the spike to obviate undesirable so-called "spike marks" on the putting green, in which improved spike the plastic is embodied in a construction which facilitates tightening and untightening the spike.

EXAMPLES OF THE PRIOR ART

Spike marks adversely effect putting accuracy and it is currently a practice of golf courses to prohibit putting green-marking metal conical spikes such as those of U.S. Pat. No. 1,953,477 for Shoe Cleat Attachment issued to M. Goldenberg on Apr. 3, 1934, and U.S. Pat. No. 2,207,476 for Shoe Stud issued to J. R. Bernstein on Jul. 9, 1940, to mention a few of many prior patents exemplary of the spikes now being prohibited. The undesirable marking of the putting green with spike impressions is obviated by substituting for metal a plastic construction material for the spike as exemplied by the product sold by Softspikes, Inc. of Rockville, Md. under the trademark "Softspikes". The softer plastic, however, exhibits a tendency to rupture or breakdown at locations at which it is contacted by cooperating contact surfaces of an appropriate tool used to tighten and untighten the spike from its threaded engagement to the golf shoe sole, particularly, as often happens, if the spike is stuck in its place.

Broadly, it is an object of the present invention to overcome the foregoing currently experienced shortcoming in the use of plastic spikes, as well as overcome other shortcomings of prior art metal golf shoe spikes.

More particularly, it is an object to provide reinforced plastic contact surfaces on the spike which accommodates a tightening and untightening torque without rupture or material breakdown, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
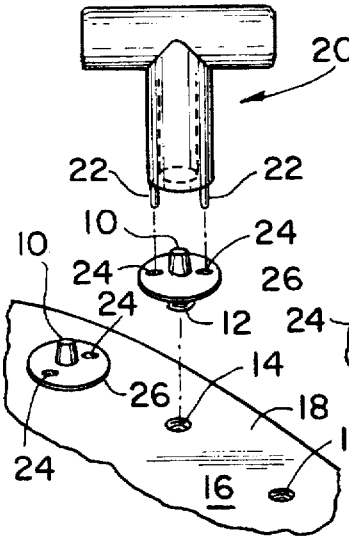
FIG.1 PRIOR ART
FIG. 1 is a perspective view of a prior art golf shoe spike of metal construction material and a wrench for tightening and untightening the spike.

Until recently, and as illustrated in FIG. 1, golf courses permitted the use of a golf shoe spike of metal construction material, despite its undesirable cause of so-called "spike marks" on putting greens which impacted adversely on putting proficiency, such prior art spike having a forwardly extending ground-engaging spike per se, designated 10, a rearwardly extending threaded projection 12 which threadably engaged a threaded opening 14 in the golf shoe sole 18. Being of metal, there was sufficient rigidity to tighten and untighten spike 10 using a known wrench 20 with depending prongs 22 projecting into openings 24 in the metal body 26 of spike 10.

Figure 2:
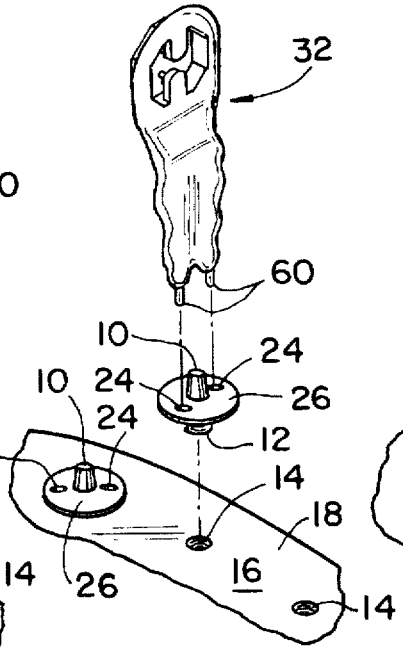
FIG. 2 is a duplicate of FIG. 1, but showing use of the wrench of the within invention for tightening and untightening the spike of FIG. 1.
Figure 3:
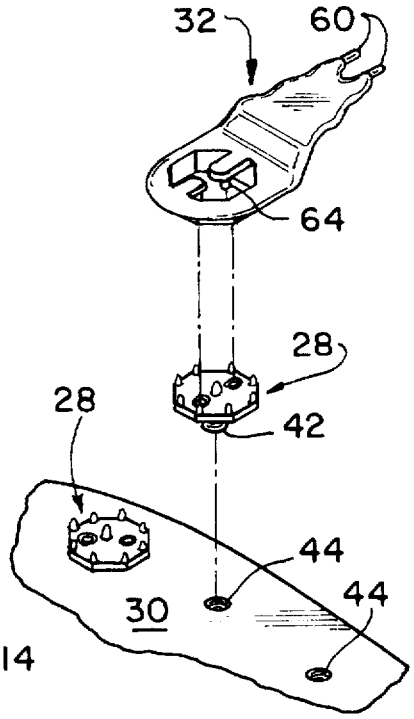
FIG. 3 is a view at the same perspective as FIGS. 1 and 2 but showing the construction of the within inventive golf shoe spike of plastic construction material and the tightening and untightening thereof using the wrench of FIG. 2.
Figure 4:
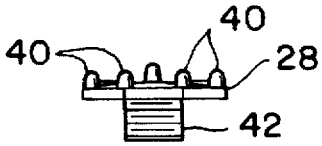
FIG. 4 is an isolated side elevational view of the golf shoe spike of FIG. 3.
Figure 5:
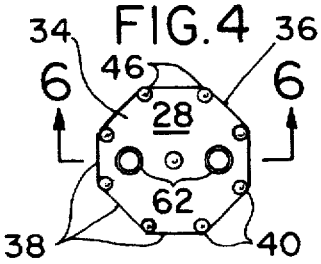
FIG. 5 is a plan view projected from FIG. 4.
Figure 8:
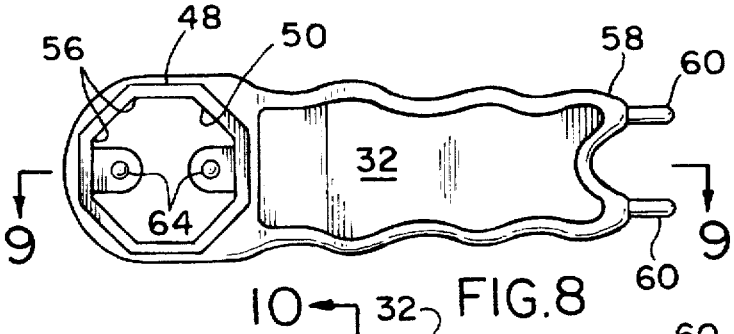
FIG. 8 is a bottom view as taken along line 8—8 of FIG. 7.
Figure 10:
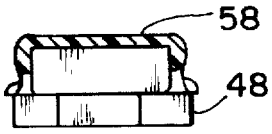
FIG. 10 is a cross sectional view as taken along line 10—10 of FIG. 9.
Figure 9:
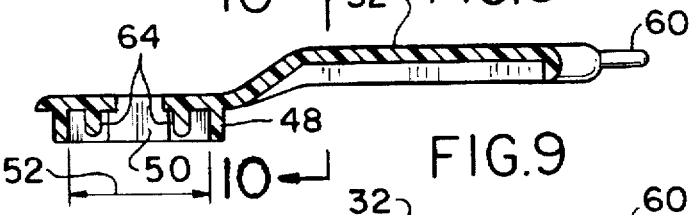
FIG. 9 is a cross sectional view as taken along line 9—9 of FIG. 8.
Figure 6:
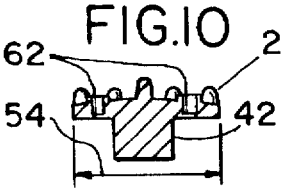
FIG. 6 is a cross sectional view as taken along line 6—6 of FIG. 5.
Figure 7:
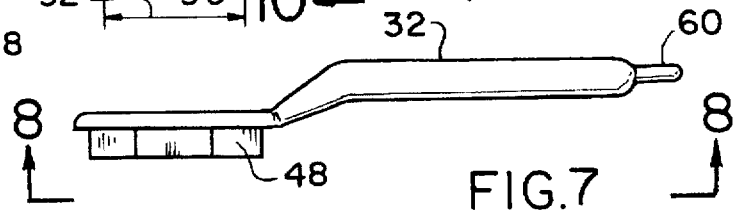
FIG. 7 is an isolated side elevational view of the wrench of FIG. 3.

In response to objections to putting green "spike marks", golf courses require a substitution from metal to plastic construction material for golf shoe spikes, which material substitution is implemented by the within inventive golf shoe spike 28, as shown in its operative condition on a golf shoe sole 30 in FIG. 3 and in isolated perspective from various views in FIGS. 4, 5, 6 and 10, the plastic golf shoe spike 28 being effectively tightened and untightened using the wrench generally designated 32, which optionally can also be used with the metal spike 10 as illustrated in FIG. 2, but which primarily is intended for use in conjunction with the plastic spike 28, said wrench 32 being illustrated in isolated perspective in FIGS. 7, 8 and 9.

Underlying the present invention is the recognition that, although plastic is significantly less effective than metal in resisting rupturing, as might occur during the tightening and untightening of a plastic spike 28, an improved construction of the spike, as will be better understood as the description proceeds, obviates the rupturing tendency.

More particularly, the plastic body 34 of spike 28 is provided with a non-circular peripheral edge, generally designated 36, which in the preferred illustrated embodiment is octagonal and consists of eight end-to-end length portions, individually and collectively designated 38, forming at intersections of changes in direction circumferentially spaced-apart locations, individually and collectively designated 40, which aptly constitute bearing surfaces in that they are destined to be contacted by the wrench 32 during tightening and untightening of the spike 28. At the contact sites 40, however, being of plastic construction material, the bearing load that could ordinarily be tolerated before rupture or breakdown of the intersection edges or sites 40 would not be acceptable for removal of a worn spike 28 that, as often happens, is stuck in its threaded engagement of its threaded projection 42 within the threaded golf shoe threaded opening 44. Effectively supplementing the ability of the contact sites 40 to resist rupture are conical-shaped spikes per se, individually and collectively designated 46, each strategically located at a cooperating contact site 40.

Cooperating with the plastic spike 28 is the previously noted wrench 32 which is embodied with a non-circular wall 48 bounding an open spike-receiving compartment 50 appropriately slightly oversized, as noted at 52 and octagonally shaped to be disposed in encircling relation about the non-circular peripheral edge of the spike body which is slightly undersized in diameter, as noted at 54. Thus, the size difference 52 and 54 provides a fitting clearance between the spike body 34 and wrench compartment 50, and this clearance is taken up in the initial turning traverse of the wrench 32, and the subsequent turning traverses occurring as should be readily understood with engagement established at the cooperating contact sites 56 of the wrench and 40 of the spike, results in the tightening or untightening of the plastic spike 28.

For completeness' sake it is noted that, at the proximal end of the wrench handle 58, i.e. that end opposite the compartment 50, there are provided spike-engaging prongs 60 for tightening and untightening metal spikes 10 (FIG. 2) and also for even tightening and untightening plastic spikes that are not too tightly stuck in place, wherein said prongs 60 engage cylindrical projections 62 that optionally can be provided on the spike body 34. If the projections 62 are provided, an allowance is made in the provision of prongs 64 extending inwardly of the compartment 50. The male prongs 60 and female cylindrical projections 62 interconnection with each other also supplement the ability to tighten and untighten the plastic spike 28 without a construction material rupture, but in practice has been found not to be essential but, as already noted, only optional.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An improved golf shoe spike of a type having a ground-engaging body and a rearward threaded means for establishing tightening and untightening relation between said spike and said golf shoe, said golf spike comprising said body constituted of plastic construction material to contribute to imparting nominal impressions in a golf course putting green, a non-circular peripheral edge on said body consisting of end-to-end length portions forming at intersections of changes in direction circumferentially spaced-apart locations of nominal bearing surface for said tightening and untightening of said golf shoe spike body, and raised circular spike-like projections each located at said change-in-direction locations to supplement said bearing surface for establishing spike-turning contact sites, and a wrench for tightening and untightening said golf shoe spike, said wrench comprising wall means bounding a non-circular shaped opening serving as a spike-receiving compartment matching said non-circular shape of said spike body and oversized in relation thereto to establish a fitting clearance to facilitate placing said spike-receiving compartment in encircling relation about said spike body, said non-circular wrench wall means establishing wrench-turning contact sites at said change-in-direction of said compartment-bounding wall means, whereby said wrench in said encircling relation about said spike body in response to being urged in rotation initially takes up said fitting clearance and thereafter establishes engagement between cooperating wrench and spike-turning contact sites to cause either tightening or untightening rotation of said spike.

* * * * *